US005566559A

United States Patent [19]

Chen

[11] Patent Number: 5,566,559

[45] Date of Patent: Oct. 22, 1996

[54] DYEING MACHINE WITHOUT ROLLERS

[76] Inventor: Fang-Ping Chen, P.O. Box 82-144, Taipei, Taiwan

[21] Appl. No.: 523,641

[22] Filed: Sep. 5, 1995

[51] Int. Cl.[6] ..... D06B 3/28

[52] U.S. Cl. ..... 68/177

[58] Field of Search ..... 68/177, 178, 18 F

[56] References Cited

U.S. PATENT DOCUMENTS

| | | | |
|---|---|---|---|
| 3,782,138 | 1/1974 | Kawasaki et al. | 68/177 |
| 4,578,085 | 3/1986 | Ishimaru | 68/177 X |
| 5,425,254 | 6/1995 | Fang-Ping | 68/177 |

FOREIGN PATENT DOCUMENTS

| | | | |
|---|---|---|---|
| 257092 | 6/1988 | Germany | 68/177 |
| 9150 | 3/1985 | Japan | 68/177 |
| 30778 | 7/1985 | Japan | 68/177 |

*Primary Examiner*—Philip R. Coe
*Attorney, Agent, or Firm*—Alfred Lei

[57] ABSTRACT

A dyeing machine without rollers including a circular trough having a neck portion at an upper portion, a tail portion having an upper inlet extending upwardly and then vertically downwardly to form a lower outlet, a large tubular passage located under the neck portion of the circular trough and connected with the neck portion of the circular trough and the lower outlet of the tail portion, a small tubular passage connected between the neck portion of the circular trough and an upper inlet of the tail portion, a first chamber mounted on the large tubular passage and provided at a bottom with a first filtering net, a second chamber mounted on the large tubular passage and provided at a bottom with a second filtering net, a branch pipe connecting the first and second chambers with the circular trough, and a pump connected with the first and second chambers through the branch pipe.

1 Claim, 3 Drawing Sheets

DYEING MACHINE WITHOUT ROLLERS

BACKGROUND OF THE INVENTION

It has been found that the conventional dyeing machine (see FIGS. 1 and 2) utilizes rollers to convey the cloth. However, the speed of the roller cannot adapt to the travelling speed of the cloth thereby making the cloth twist together and therefore damaging the surface of the cloth.

Therefore, it is an object of the present invention to provide a dyeing machine without rollers which may obviate and mitigate the above-mentioned drawbacks.

SUMMARY OF THE INVENTION

This invention relates to a dyeing machine without rollers.

It is the primary object of the present invention to provide a dyeing machine without rollers which utilizes cyclic dyeing liquid to move the cloth.

It is another object of the present invention to provide a dyeing machine without rollers which can evenly and rapidly dye the cloth.

It is still another object of the present invention to provide a dyeing machine without rollers which can prevent the cloth from twisting together.

It is still another object of the present invention to provide a dyeing machine without rollers which can make the cloth naturally stack up in the large tubular passage.

It is a further object of the present invention to provide a dyeing machine without rollers which can reduce the required amount of dyeing liquid.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
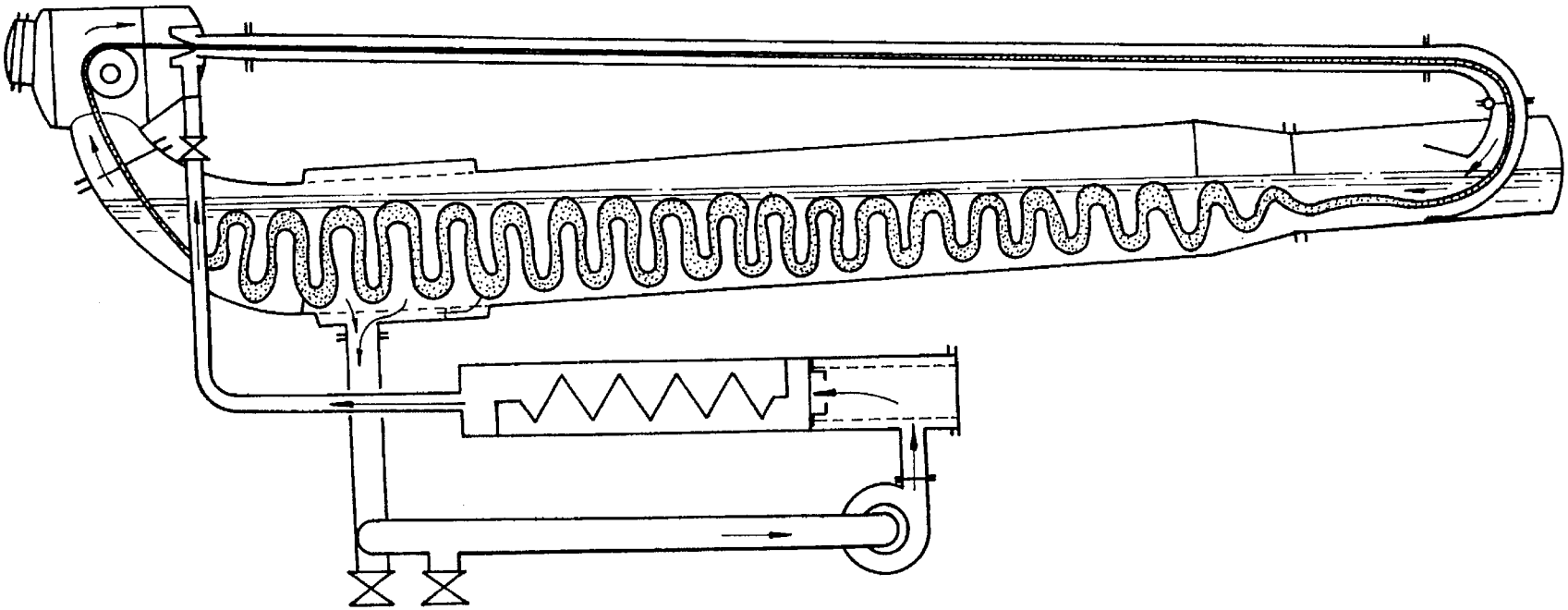
PRIOR ART FIG. 1
FIG. 1 illustrates a first prior art dyeing machine.
Figure 2:
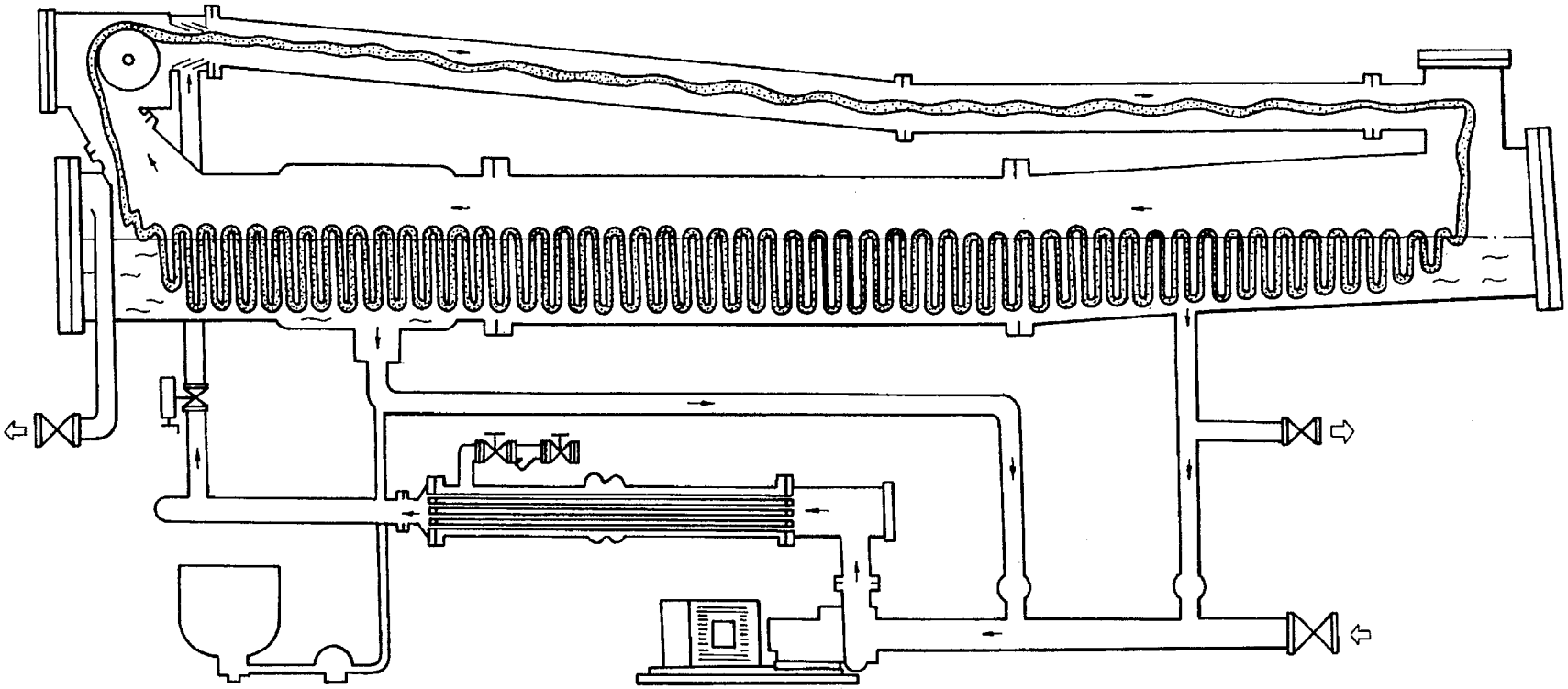
PRIOR ART FIG. 2
FIG. 2 illustrates a second prior art dyeing machine.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
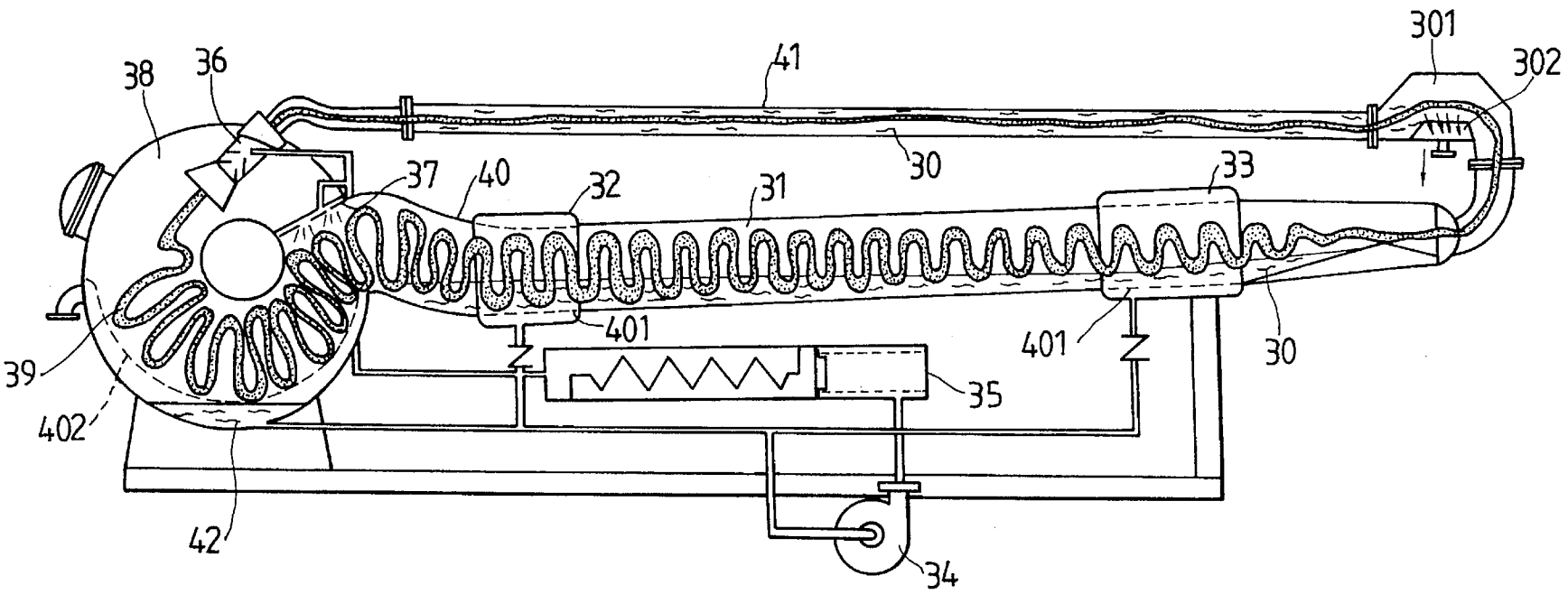
FIG. 3 illustrates the structure of the present invention.

With reference to the drawings and in particular to FIG. 3 thereof, the dyeing machine according to the present invention mainly comprises a circular trough 38, a large tubular passage 31, a small tubular passage 41, and a tail portion 301.

The circular trough 38 is provided at an upper portion with a nozzle 36 which is connected with an inlet of the small tubular passage 41. The lower portion of the circular trough 38 is connected with an outlet of the large tubular passage 31. The circular trough 38 is provided at the bottom with a curved filtering net 402. The circular trough 38 is formed with a neck portion 40 which is located above the large tubular passage 31. As the dyeing liquid 30 rushes into the small tubular passage 11 and dyeing cloth 39 simultaneously. Since the cloth 20 is not conveyed by rollers, it is no longer necessary to take friction into consideration and so the cloth 20 will not be damaged any longer. The outlet of the small tubular passage 41 is connected with the tail portion 301 which has an upper inlet extending upwardly and then vertically downwardly to form a lower outlet. Hence, the small tubular passage 41 is filled with dyeing liquid thus thoroughly dyeing the cloth 39 in advance. As the tail portion 301 first goes upwardly before extending downwardly, the vertical distance between the small tubular passage 41 and the large tubular passage 31 will be increased thereby providing a larger space for the cloth 39 and therefore preventing the cloth 39 from twisting together. In addition, the cloth 39 will be naturally stacked up in the large tubular passage 31 in order. Afterwards, part of the dyeing liquid flows down into the large tubular passage 31 through a filtering baffle 302 and the remaining part of the dyeing liquid goes down into the large tubular passage 31 together with the cloth 39. In the meantime, the excessive dyeing liquid 30 collected by two chambers 32 and 33 will be heated by a heat exchanger 35 and then forced to flow to the nozzle 36 via a branch pipe by a pump 34 thereby circulating the dyeing liquid in the dyeing machine. The chambers 32 and 33 are each provided with a filtering net 401 at the bottom.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A dyeing machine without rollers comprising:

a circular trough having a neck portion at an upper portion thereof;

a tail portion having an upper inlet extending upwardly and said tail portion then extending vertically downwardly to form a lower outlet;

a large tubular passage located under the neck portion of said circular trough and connected between the neck portion of said circular trough and the lower outlet of said tail portion;

a small tubular passage connected between said circular trough and said upper inlet of said tail portion;

a first chamber mounted on said large tubular passage and provided at a bottom thereof with a first filtering net;

a second chamber mounted on said large tubular passage and provided at a bottom with a second filtering net;

a branch pipe connecting said first and second chambers with said circular trough; and a pump connected with said first and second chambers through said branch pipe for forcing excessive dyeing liquid collected by said chambers to flow to said circular trough.

* * * * *